US010161695B2

(12) United States Patent
Burfeind

(10) Patent No.: US 10,161,695 B2
(45) Date of Patent: Dec. 25, 2018

(54) COIL CLEANING SYSTEM

(71) Applicant: Scott P. Burfeind, Prior Lake, MN (US)

(72) Inventor: Scott P. Burfeind, Prior Lake, MN (US)

( * ) Notice: Subject to any disclaimer, the term of this patent is extended or adjusted under 35 U.S.C. 154(b) by 107 days.

(21) Appl. No.: 15/499,436

(22) Filed: Apr. 27, 2017

(65) Prior Publication Data

US 2017/0227306 A1 Aug. 10, 2017

Related U.S. Application Data

(62) Division of application No. 14/550,066, filed on Nov. 21, 2014, now Pat. No. 9,664,463.

(60) Provisional application No. 61/909,603, filed on Nov. 27, 2013.

(51) Int. Cl.

| | |
|---|---|
| ***F28G 1/16*** | (2006.01) |
| ***F28G 15/00*** | (2006.01) |
| ***B08B 3/02*** | (2006.01) |
| ***B08B 3/08*** | (2006.01) |
| ***B08B 5/02*** | (2006.01) |

(52) U.S. Cl.

CPC ..... *F28G 1/166* (2013.01); *B08B 3/026* (2013.01); *B08B 3/08* (2013.01); *B08B 5/02* (2013.01); *F28G 15/003* (2013.01)

(58) Field of Classification Search

None

See application file for complete search history.

(56) References Cited

U.S. PATENT DOCUMENTS

| | | | |
|---|---|---|---|
| 2,802,697 | A | 8/1957 | Pumphrey |
| 3,680,786 | A | 8/1972 | Levy |
| 4,025,362 | A | 5/1977 | Frauenfeld |
| 4,141,754 | A | 2/1979 | Frauenfeld |
| 4,591,095 | A | 5/1986 | Fama |
| 5,040,262 | A | 8/1991 | Albers et al. |
| 6,062,486 | A | 5/2000 | Hill |
| 6,318,108 | B1 | 11/2001 | Holstein et al. |
| 6,743,279 | B2 | 6/2004 | Cataldo |
| 6,935,579 | B1 | 8/2005 | Lindsey |
| 7,132,017 | B2 | 11/2006 | Laurence |
| 7,507,299 | B2 | 3/2009 | Wadsworth et al. |
| 8,468,648 | B1 | 6/2013 | Smith et al. |
| 2001/0041517 | A1 | 11/2001 | Manfredi |
| 2003/0024485 | A1 | 2/2003 | Freidell |
| 2003/0024552 | A1 | 2/2003 | Watanabe |

(Continued)

FOREIGN PATENT DOCUMENTS

| | | | |
|---|---|---|---|
| EP | 0141544 | B1 | 12/1987 |
| JP | 2007136352 | A | 6/2007 |

(Continued)

*Primary Examiner* — Eric W Golightly

(74) *Attorney, Agent, or Firm* — Kinney & Lange, P.A.

(57) ABSTRACT

A cleaning apparatus comprising a first fluid delivery system configured to eject a first fluid through a first nozzle toward a surface to be cleaned; a second fluid delivery system configures to eject a second fluid through a second nozzle toward the surface to be cleaned, wherein the second fluid comprises a compressed gas at a pressure greater than 345 kilopascals (50 pounds per square inch); a housing configured to partially surround and mount the first and second nozzles; a connector configured to couple the first fluid delivery system to a first fluid source; and a connector configured to couple the second fluid delivery system to a second fluid source.

13 Claims, 7 Drawing Sheets

(56) References Cited

U.S. PATENT DOCUMENTS

| | | | |
|---|---|---|---|
| 2004/0028816 | A1 | 2/2004 | Ackerman et al. |
| 2008/0120802 | A1 | 5/2008 | Harvey |
| 2009/0090138 | A1 | 4/2009 | Wang |
| 2013/0160800 | A1 | 6/2013 | Steinmann |
| 2014/0060584 | A1 | 3/2014 | Boucher et al. |

FOREIGN PATENT DOCUMENTS

| | | | |
|---|---|---|---|
| JP | 2009160530 | A | 7/2009 |
| JP | 2010115642 | A | 5/2010 |
| JP | 2012035166 | A | 2/2012 |

COIL CLEANING SYSTEM

CROSS-REFERENCE TO RELATED APPLICATION(S)

This application is a divisional of U.S. application Ser. No. 14/550,066 filed Nov. 21, 2014, and issued as U.S. Pat No. 9,66,4463 on May 30, 2017 for "Coil Cleaning System" by Scott P. Burfeind.

BACKGROUND

The present disclosure relates to cleaning equipment, and more specifically, to a cleaning apparatus for heat exchanging coils.

Heat exchanging coils such air conditioning/refrigeration coils, process fluid coolers, hydraulic fluid coolers, and similar mechanical structures require regular cleaning to maintain efficient heat transfer. Such heat exchangers generally comprise a tube containing a refrigerant surrounded by a plurality of thin metal plates or fins. A fan drives ambient air through the fins and around the tubes to draw heat from the refrigerant. The fins serve to increase the surface area of heat transfer and, therefore, are generally stacked close together (passageways may be less than 2.5 millimeters wide). While such configuration improves the heat exchanging capacity, efficiency declines as the fins clog with oils, dust, pollen, plant seeds, process by-products, and other contaminants present in the ambient air.

Conventional coil cleaning methods include the use of chemical cleaners, brushes, high pressure water delivered from pressure washers or backpack sprayers, and compressed air. Each has advantages and disadvantages. Brushes and chemical cleaners may effectively loosen contaminants, but are ineffective at removing them from the coil. Water and water-based chemical spraying systems may remove oils that have caked onto the coil, but due to surface tension or friction of water, high pressure is required to force the liquid fluid and contaminants through the narrow passageways of the coil. Additionally, the large volume of water required to clean the coil can damage other components of the system. High pressure air effectively carries contaminants such as dust and debris out of the coil, but may not have enough force to loosen and remove hardened buildup or remove the oils which, if left in place, attract additional contaminants.

Both high pressure water and compressed air systems generally require small nozzles or orifices to deliver a high pressure stream of fluid. The small nozzles limit the effective cleaning area, which increases the amount of time it takes to clean the coil and the amount of cleaning fluid required. Additionally, the pressure required to remove contaminants from the coil is sufficient to bend, fold, or damage the thin metal fins. When fins are bent such that they abut adjacent fins or reduce the space between adjacent fins, heat exchanging efficiency is lost and the narrower passageways become more difficult to clean. Operators must use care in spraying the coil to avoid such damage.

In addition to conventional coil cleaning systems, the prior art discloses a low-pressure air coil cleaning system (U.S. Pat. No. 7,132,017), such as a leaf blower, that may be equipped with a cleaning fluid injector to create a "cleaning fluid mist." The air pressure of the prior art system is too low to damage coil fins, but also too low to drive a cleaning fluid into the narrow coil passageways and force the cleaning fluid and contaminants out of the coil.

There is a need for an improved coil cleaning system that is capable of removing all types of contaminants from the narrow coil passageways in a single application, while also reducing the risk of damaging the coil fins and reducing the labor time needed.

SUMMARY

A cleaning apparatus comprising a first fluid delivery system configured to eject a first fluid through a first nozzle toward a surface to be cleaned; a second fluid delivery system configures to eject a second fluid through a second nozzle toward the surface to be cleaned, wherein the second fluid comprises a compressed gas at a pressure greater than 345 kilopascals (50 pounds per square inch); a housing configured to partially surround and mount the first and second nozzles; a connector configured to couple the first fluid delivery system to a first fluid source; and a connector configured to couple the second fluid delivery system to a second fluid source.

Another embodiment is a cleaning apparatus configured to clean a coil of a heat exchanger, comprising: a spray nozzle configured to deliver a first fluid; a discharge channel with a plurality of apertures configured to deliver a second fluid; a housing configured to mount and partially surround the spray nozzle and the discharge channel to allow delivery of the first and second fluids to the coil, wherein the discharge channel is configured to deliver the second fluid into a discharge stream of the first fluid; a first connector configured to couple the spray nozzle to a first fluid source; a second connector configured to couple the discharge channel to a second fluid source; and a valve to adjust at least one of a first or second fluid flow rate or pattern of discharge.

A method for cleaning a heat exchanger coil comprising: connecting a first fluid delivery system to a first fluid source, wherein the first fluid comprises a cleaning agent selected from the group consisting of water, solvents, detergents, and a combination thereof; connecting a second fluid delivery system to a second fluid source, wherein the second fluid comprises a compressed gas; delivering a first fluid through a first nozzle of the first fluid delivery system toward the coil in a fluid stream, wherein the first nozzle is mounted in the cleaning apparatus housing; delivering a second fluid through a second nozzle of the second fluid delivery system into the first fluid stream, creating a second fluid stream, wherein the second nozzle is mounted in the cleaning apparatus housing; adjusting at least one of the rate and pattern of flow or at least one of the first and second fluid delivery systems with valves connected to the cleaning apparatus to create a fluid mixture capable of removing particulate matter from the heat exchanging coil without bending coil fins; and positioning the cleaning apparatus housing within two feet of the coil.

DETAILED DESCRIPTION

The coil cleaning apparatus 10 combines two methods of coil cleaning—gaseous and liquid, such as compressed air and water—by directing a high-pressure stream of compressed gas into a lower-pressure liquid stream. The high-pressure gaseous stream disperses the liquid stream into fine droplets capable of entering the confined spaces of the coil and forces the droplets and the contaminants they entrain through the narrow passageways and out of the coil 50 without damaging fragile coil fins. The simultaneous application of high-pressure gas and liquid fluid cleaning methods results in fewer labor hours required to clean the coil and a more thorough cleaning than can be achieved using one method alone or the low-pressure mixed stream cleaning system disclosed in the prior art. Additionally, a reduced run time of equipment saves energy, which in turn extends the life cycle of the heat transfer equipment; and use of a compressed gas to more evenly disperse a liquid cleaning fluid reduces the amount of water required when compared to water-based single fluid cleaning systems, such as garden hoses and pressure washers.

The coil cleaning apparatus 10 simultaneously discharges gaseous and liquid fluids to create a high-pressure, high-velocity dense mist comprising approximately 70 percent gas and 30 percent liquid fluid. The prior art discloses a "cleaning fluid mist" created by mixing a liquid cleaning fluid with a low-pressure stream of air (U.S. Pat. No. 7,132,017). A fluid mist is ineffective as a cleaning agent unless it can be delivered to the coil in droplets that are of sufficiently small size to reach the confined spaces within the coil and with sufficient pressure to dislodge and carry away oils, dirt, debris, and other contaminants. By combining a liquid fluid with a high-pressure gas, the coil cleaning apparatus creates a high-pressure, high-velocity dense mist capable of removing contaminants from the narrow passageways of the coil. The low-pressure air stream of the prior art may disperse a portion of the liquid cleaning fluid into a fluid mist, but it would not have sufficient force to drive the liquid cleaning fluid and hardened buildup through the narrow passageways of the coil.

Figure 1:
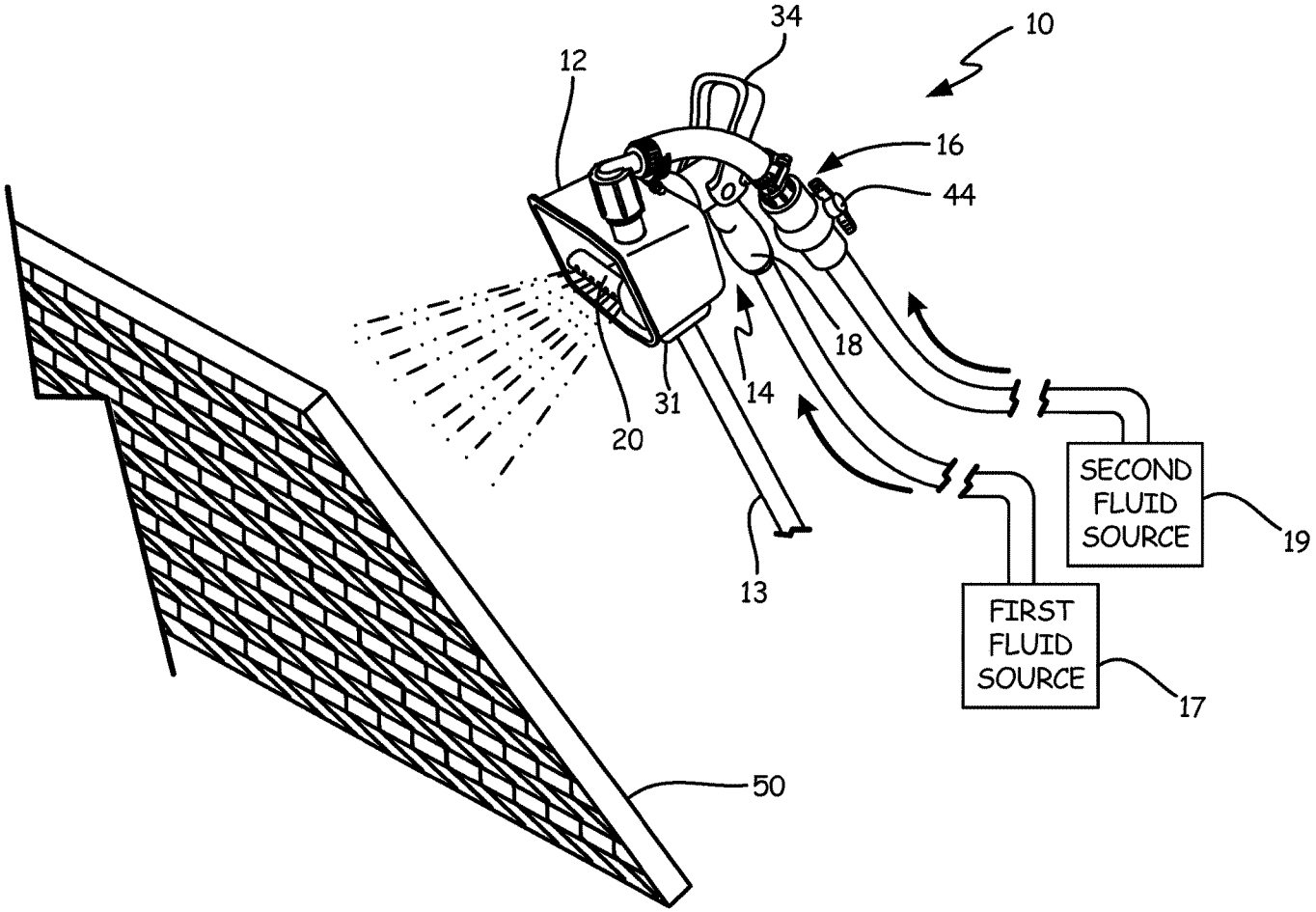
FIG. 1 is a perspective view of a coil cleaning apparatus and a coil.
Figure 2:
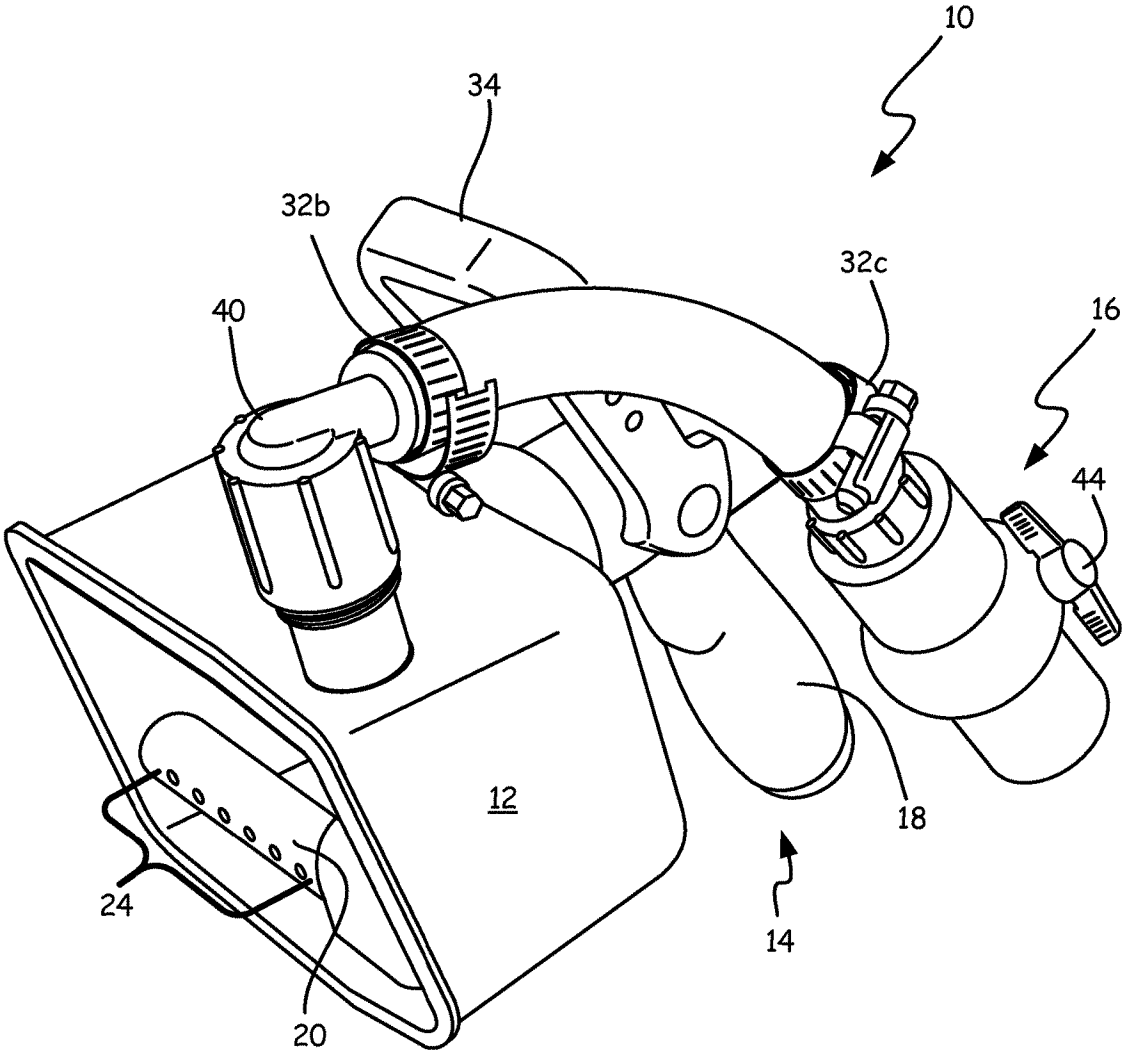
FIG. 2 is a perspective view of the coil cleaning apparatus.
Figure 3:
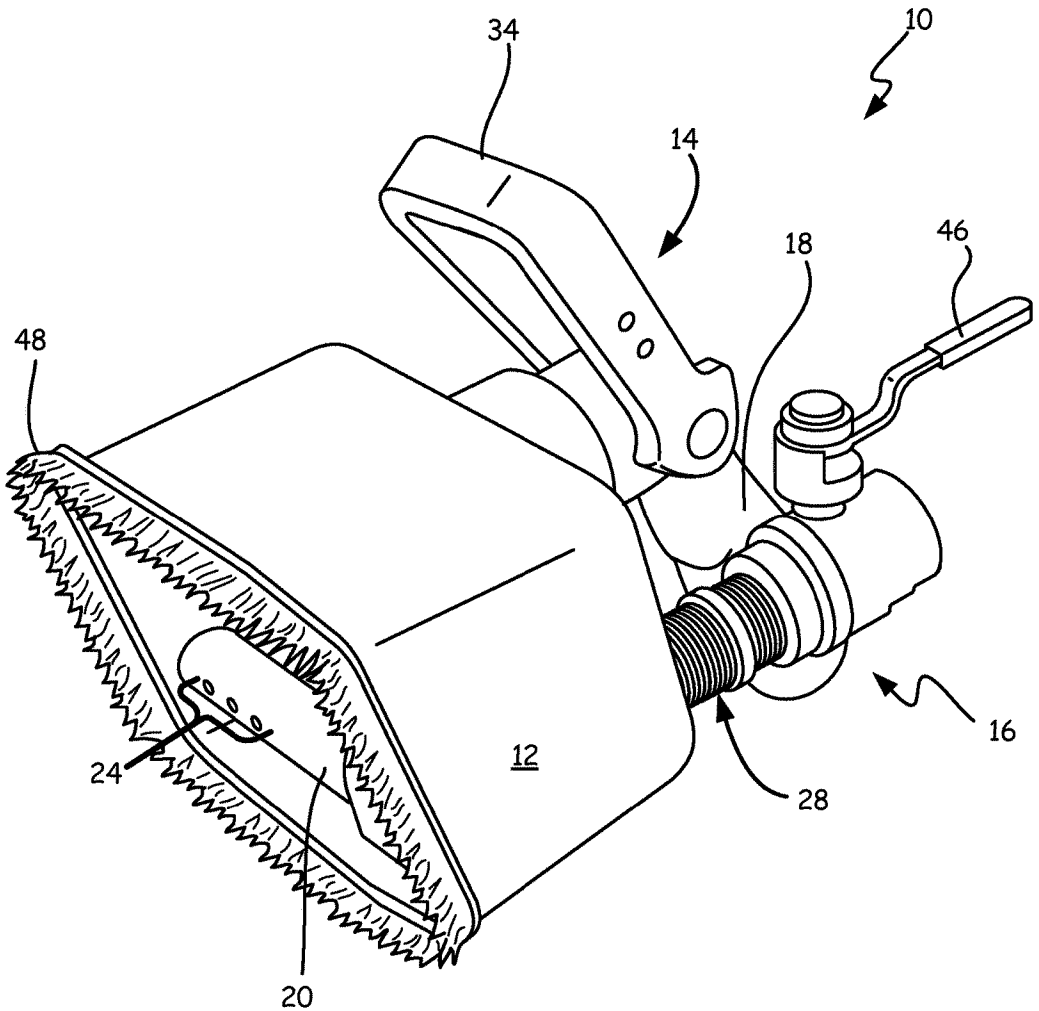
FIG. 3 is a perspective view of an alternate embodiment of the coil cleaning apparatus.

FIGS. 1-3 illustrate various views of a coil cleaning apparatus 10 that combines gaseous and liquid coil cleaning methods to effectively remove contaminants from a heat exchanging coil without damaging coil fins and while saving time and water.

FIG. 1 shows a perspective view of the coil cleaning apparatus 10 and a coil 50. The coil cleaning apparatus 10 includes a housing 12 that serves to fixedly mount a first and second fluid delivery system 14, 16 into a single structural unit and in a configuration that allows the second fluid, typically gaseous, to disperse and force the first fluid, typically liquid, through the coil 50. The housing 12 partially surrounds the discharge ends of the first and second fluid delivery systems 14, 16, opening toward the coil 50. The housing 12 is constructed from a rigid or semi-rigid material, such as plastic. The housing 12 may serve to define the area to be cleaned as the housing 12 is positioned close to the coil during operation—generally within 1 to 5 centimeters.

In one embodiment, the housing 12 is a rectangular box open on one side. The open side of the housing 12 extends slightly beyond a nozzle 20 on the discharge end of the second fluid delivery system 16 to prevent the nozzle 20 from contacting the coil 50. It will be understood by those skilled in the art that the shape of the housing 12 can be modified to accommodate variations in fluid delivery systems and desired fluid discharge patterns. The liquid fluid is projected outward from the coil cleaning apparatus 10 to cover the coil 50 evenly. The nozzle 20 of the second fluid delivery system 16 is positioned near the bottom front of the housing 12 and emits a compressed gas, which forces the liquid fluid of the first fluid delivery system through the narrow passageways of the coil 50 and out of the coil 50.

The first fluid delivery system 14 is mounted through the back wall of the housing 12 and the second fluid delivery system 16 is mounted through the top of the housing 12. The first fluid delivery system 14 may comprise a nozzle (not pictured), which is mounted through the back wall of the housing 12, and a handle 18, which remains outside of the housing 12. The second fluid delivery system 16 is mounted through the top of the housing 12 so as to not obstruct the use of the handle 18 of the first delivery system 14. The second fluid delivery system 16 includes an elbow connector 18 to minimize the vertical dimension of the coil cleaning apparatus 10. Both first and second fluid delivery systems 14, 16 may also be connected to tubes, hoses, valves, and similar fluid delivery structures. Connections may be of a permanent type, such as PVC pipe and glue, or detachable. Detachable connectors may include adjustable hose clamps, threaded connectors, quick couplers, and similar connection mechanisms. Valves 34, 44 may be present to control the rate of delivery of the fluids through the delivery systems, or to entirely stop the delivery of one or both fluids.

The first and second fluid delivery systems are connected to a first 17 and second fluid source 19, respectively. The first fluid is typically a liquid, which may include water or a solution of water and cleaning agents, such as solvents and detergents. In one embodiment, the first fluid delivery system is connected to a garden hose. In an alternate embodiment, the first fluid delivery system is connected to a system configured to deliver both water and a cleaning solution.

The second fluid is typically gaseous. In one embodiment, the second fluid delivery system 16 is connected to an air compressor through a quick coupler. In an alternate embodiment, the second fluid delivery system is connected to a source of compressed gas, such as a carbon dioxide tank or compressed gas generating system.

The coil cleaning apparatus 10, as disclosed, utilizes approximately 70 percent compressed gaseous fluid and 30 percent liquid fluid. The high-pressure gas disperses the liquid fluid into fine droplets capable of entering confined spaces within the coil and forces the droplets and the contaminants they entrain through and out of the coil 50. While the 70 percent gaseous fluid, 30 percent liquid fluid combination is capable of removing the hardened buildup in most heat exchanger coils, various combinations may be employed to achieve acceptable results. In general, the optimal percentage of water ranges from 15 to 35 percent, whereas, the optimal percentage of gas ranges from 65 to 85 percent. The valves 34, 44 incorporated into the coil cleaning apparatus 10 allow the operator to adjust the ratio of gaseous fluid flow to liquid fluid flow as required for optimal cleaning of the heat exchanger coil 50.

The coil cleaning apparatus 10 may be hand-held or attached to an extension pole 13 for improved reach or mechanical control. The extension pole 13 may be detachably fixed to the housing 12 with a connector 31. The coil cleaning apparatus 10 is designed to be operated in close proximity to the coil 50. In one embodiment, the coil cleaning apparatus 10 is operated at a distance of approximately 1 to 5 centimeters away from the coil 50. This distance is determined based on characteristics of the fluid discharge, such as volume, flow, and pressure. In one embodiment, the gaseous and liquid fluid mixture is discharged in a rectangular pattern that covers approximately 75 square centimeters, which facilitates an even application and thorough cleaning in the rectangular pattern area. As the coil cleaning apparatus 10 is moved adjacent the coil 50, the hardened buildup is removed in the area of the rectangular pattern.

FIG. 2 shows a perspective view of one embodiment of the coil cleaning apparatus 10. A first fluid delivery system 14 is mounted through the back of the housing 12, and a second fluid delivery system 16 is mounted through the top of the housing 12 with an elbow connector 40 to minimize the vertical dimension of the coil cleaning apparatus 10. The first and second fluid delivery systems 14, 16 include valves 34, 44 for controlling the flow of the first and second fluids. Both first and second fluid delivery systems 14, 16 may be connected to tubes, hoses, valves, and similar fluid delivery structures.

The second fluid delivery system comprises a channel-style nozzle 20 with a plurality of apertures 24 for discharging a second fluid, typically a compressed gas. In one embodiment, the channel-style nozzle 20 extends generally parallel to the longer side of the housing 12 and is positioned near the front and bottom of the housing 12. The apertures 24 are positioned in front of the first fluid delivery system nozzle (not pictured). In one embodiment, the apertures are spaced equidistance along the length of the channel-style nozzle 20 and have a diameter of approximately 3 millimeters. It will be understood by one skilled in the art that the number, size, and spacing of apertures 24 may be varied as needed to disperse and force the liquid fluid through the coil 50. Typically, gaseous fluid is delivered at 620 to 689 kilopascals (90 to 100 pounds per square inch) and 0.014 to 0.028 cubic meters per second (30 to 60 cubic feet per minute). The channel-style nozzle 20 is comprised of a material that can withstand high air pressure, typically brass, copper, PVC, or a similar material.

FIG. 3 shows a perspective view of an alternate embodiment of the coil cleaning apparatus 10. In this embodiment, the first and second fluid delivery systems 14, 16 are mounted through the back of the housing 12. Mounting the second fluid delivery system 16 through the back of the housing improves flow dynamics by limiting the number of changes in direction the fluid must make before reaching the discharge point. The second fluid delivery system 16 may be detachably mounted through the back of the housing 12 with a threaded connector 28 or permanently mounted.

The second fluid delivery system includes a channel-style nozzle 20 with a plurality of apertures 24 for discharging a second fluid, typically a compressed gas. The channel-style nozzle 20 extends generally parallel to the longer side of the housing 12 and is positioned near the front and bottom of the housing 12. The apertures are spaced equidistance along the section of the channel-style nozzle 20 that is positioned in front of the discharge nozzle of the first fluid delivery system (not pictured). It will be understood by one skilled in the art that the number, size, and spacing of apertures 24 may be varied to accommodate variations in air compressor ratings and as needed to disperse and force the first fluid through the coil.

Typically, gas is delivered at 620 to 689 kilopascals (90 to 100 pounds per square inch) and 0.014 to 0.028 cubic meters per second (30 to 60 cubic feet per minute).

Both the first and second fluid delivery systems 14, 16 include valves 34, 46 configured to allow the operator to adjust the flow rate of the first and second fluid, respectively. Both valves 34, 46 are positioned near the housing 12 of the coil cleaning apparatus 10 for ease of access.

In one embodiment, the housing 12 is a rectangular box open on one end. The housing 12 includes a seal 48 around its open outer edge that contacts the coil 50 during operation. The seal 48 helps prevent loss of liquid fluid from the front of the housing 12 and prevents the housing 12 itself or the channel-style nozzle 20 from damaging the coil 50 if pressed too firmly against it. The seal 48 may be a brush, foam, or similar structure.

Figure 4:
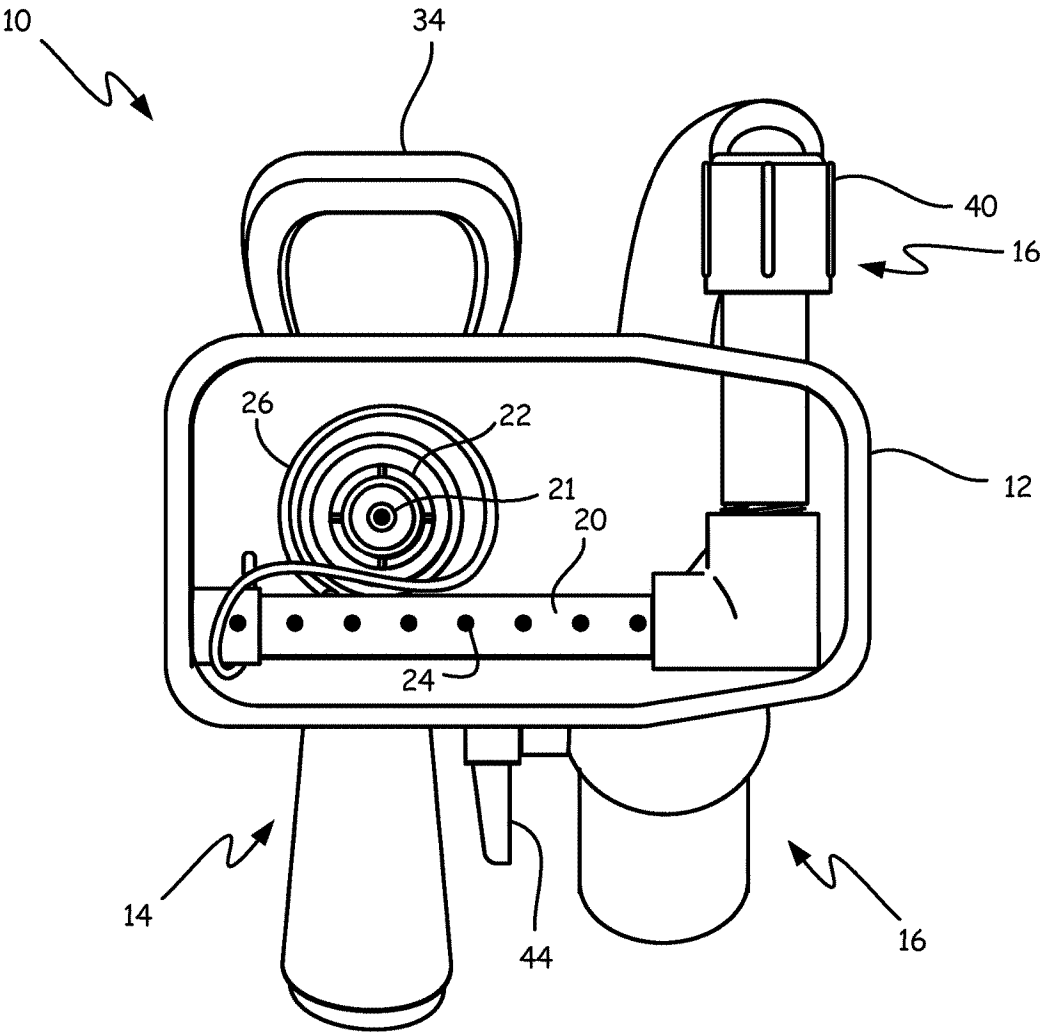
FIG. 4 is a front elevation view of the coil cleaning apparatus.

FIG. 4 shows a front elevation view of one embodiment of the coil cleaning apparatus 10. The housing 12 contains a first nozzle 22 connected to the first fluid delivery system 14 and a channel-style nozzle 20 with a plurality of apertures 24 connected to the second fluid delivery system 16. The nozzle 22 of the first fluid delivery system 14 is secured within the housing 12 by a metal coil 26, which wraps around the first fluid delivery nozzle 22 and the channel-style nozzle 20. In one embodiment, the channel-style nozzle 20 extends generally parallel to the longer side of rectangular-shaped housing 12 and is positioned downstream of the first fluid delivery nozzle 22 and below the nozzle exit point 21 such that the channel-style nozzle 20 does not interrupt the flow of the first fluid and picks up a portion of the liquid that would otherwise be lost to gravity. The nozzle 20 of the second fluid delivery system is positioned to direct the second fluid discharge stream into the first fluid discharge stream. It will be understood by one skilled in the art that the positioning and shape of the second fluid discharge nozzle may be varied to achieve the same result.

The first fluid delivery system is mounted through the back of the housing 12 and the second delivery system is mounted through the top of the housing 12. The second fluid delivery system includes an elbow connector 40 outside the housing 12 to reduce the vertical dimension of the coil cleaning apparatus 10.

Both first and second fluid delivery systems 14, 16 include a valve 34, 44 for adjusting fluid flow. Both valves 34, 44 are positioned near the housing 12 of the coil cleaning apparatus 10 for ease of access. Typically, the first fluid (liquid) is ejected at a rate of 3.8 to 18.9 liters per minute (1 to 5 gallons per minute) and the second fluid (gaseous) is delivered at 620 to 689 kilopascals (90 to 100 pounds per square inch) and 0.014 to 0.028 cubic meters per second (30 to 60 cubic feet per minute).

Figure 5:
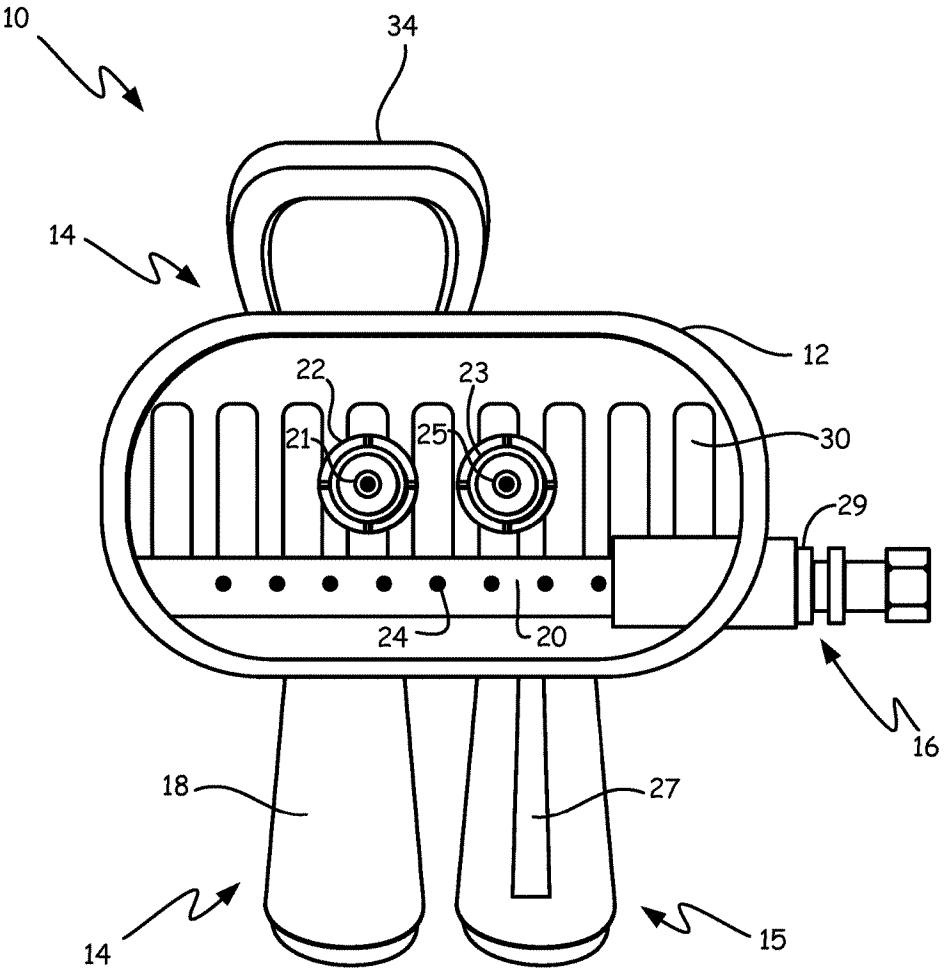
FIG. 5 is a front elevation view of and alternate embodiment of the coil cleaning apparatus.

FIG. 5 shows a front elevation view of an alternate embodiment of the coil cleaning apparatus 10. The housing 12 contains a first nozzle 22 connected to the first fluid delivery system 14, a second nozzle 23 connected to a cleaning fluid delivery system 15, and a channel-style nozzle 20 with a plurality of apertures 24 connected to the second fluid delivery system 16. The first fluid may be water; the cleaning fluid may be a solvent or detergent; and the second fluid may be a compressed gas. In one embodiment, the channel-style nozzle 20 extends generally parallel to the longer side of an oval-shaped housing 12 and is positioned downstream of the nozzles 22, 23 and below the fluid exit points 21, 25 such that the channel-style nozzle 20 does not interrupt the flow of the first fluid or cleaning fluid exiting the nozzles 22, 23.

The nozzles 22, 23 of the first fluid delivery system 14 and cleaning fluid delivery system 15 are mounted through the back of the housing 12. The nozzles 22, 23 may also be connected to tubes, hoses, valves, and similar fluid delivery structures. In one embodiment, the first fluid delivery nozzle 22 is attached to a handle 18. The handle 18 is positioned to the side of and rearward of the cleaning fluid system 15 so that it is accessible for operation of the coil cleaning apparatus 10. In an alternate embodiment, a handle of the cleaning fluid delivery system 15 is used for operation of the coil cleaning apparatus 10. The cleaning fluid delivery system 15 may comprise a squeeze trigger 27 or similar mechanism configured to discharge the cleaning fluid. The first fluid and cleaning fluid delivery nozzles 22, 23 are permanently or detachably secured to the housing 12 in a manner that prevents movement during operation. The first fluid and cleaning fluid delivery nozzles 22, 23 may contain a single fluid exit point 21, 25 as depicted in FIG. 4, 5 or a plurality of apertures distributed in a variety of patterns. Typically, water is discharged from the first fluid delivery system 14 in a cone-shaped spray. The cleaning fluid may be discharged from the cleaning fluid delivery system 15 as a foam or liquid spray as needed prior to or in combination with discharge of the first and second fluids.

The second fluid delivery system 16 is mounted through the side of the housing 12. Side mounting provides a direct route for gas through the second fluid delivery system 16, which optimizes flow dynamics. The second fluid delivery system comprises a quick coupler 29 for connection to the second fluid source. In one embodiment, the channel-style nozzle 20 is secured to the housing 12 through permanent means, such as through the use of adhesives. In an alternate embodiment, the channel-style nozzle 20 is secured utilizing non-permanent means allowing for replacement of both the channel-style nozzle 20 and the first fluid and cleaning fluid delivery nozzles 22, 23. For example, the channel-style nozzle 20 may be secured by the use of a spring mechanism or a threaded connector.

The channel-style nozzle 20 contains several apertures 24 for the release of the second fluid, which is typically gaseous. In one embodiment, the apertures 24 are spaced equidistance along the length of the channel-style nozzle 20 in a straight line. The apertures 24 are oriented to direct fluid flow toward the first fluid discharge stream such that the first and second fluids mix downstream of the channel-style nozzle 20. It will be understood by one skilled in the art that the shape and orientation of the channel-style nozzle 20 and number, size, and spacing of apertures 24 may be varied to accommodate variations in air compressor ratings and as needed to disperse and force the first fluid through the coil. Typically, air is delivered at 620 to 689 kilopascals (90 to 100 pounds per square inch) and 0.014 to 0.028 cubic meters per second (30 to 60 cubic feet per minute).

Vent holes 30 are located at the back of the housing 12, opposite the side open for fluid delivery. The vent holes 30 allow air movement through the housing, which reduces pressure on the back wall of the housing.

Figure 6:
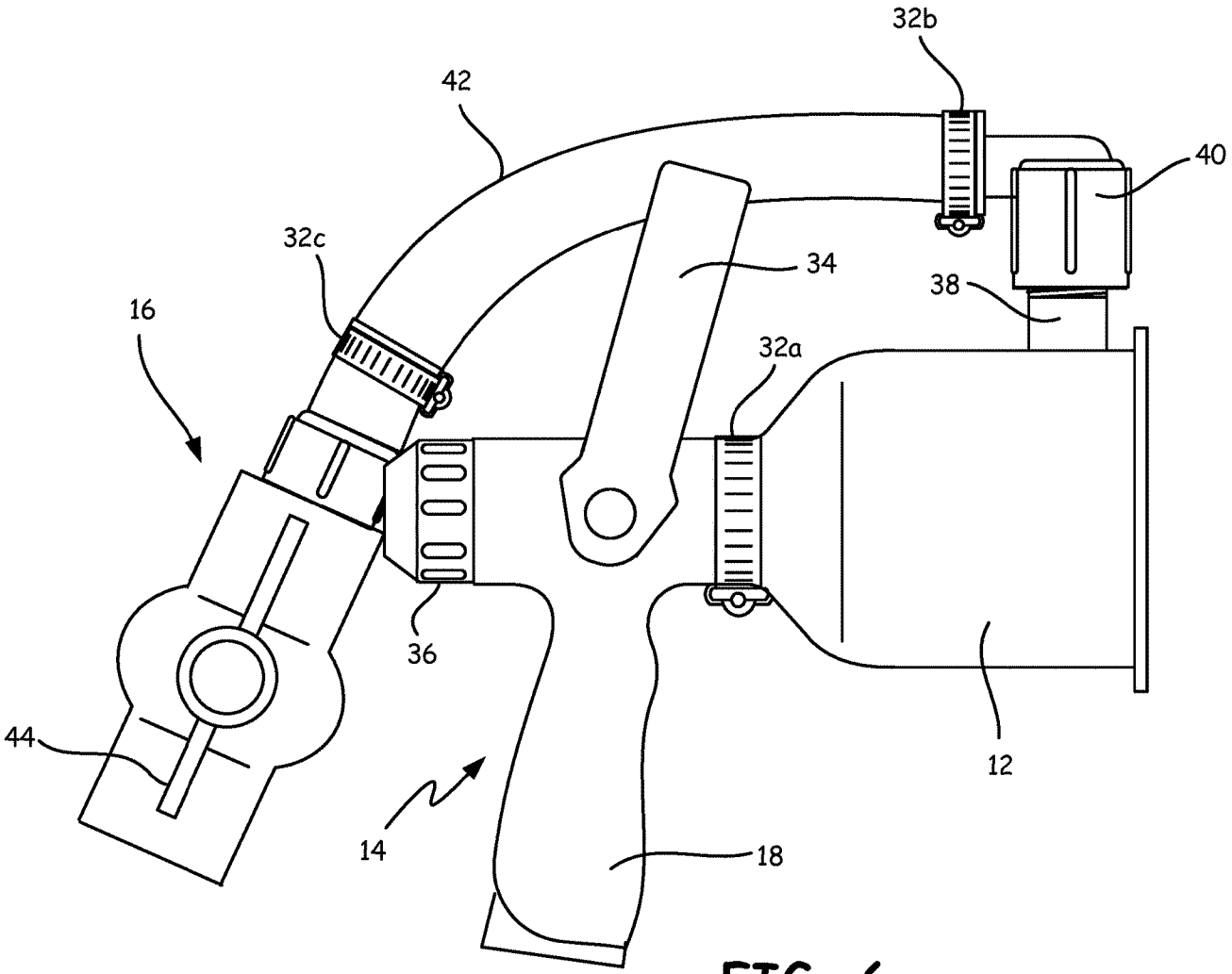
FIG. 6 is a side view of the coil cleaning apparatus.

FIG. 6 shows a side view of one embodiment of the coil cleaning apparatus 10. In this embodiment, the first fluid delivery system 14 comprises a nozzle 22 that is mounted through the back of the housing 12 with an adjustable hose clamp 32*a* and a handle 18 which remains outside of the housing 12. The first fluid delivery system 14 has a handle lever 34 for adjusting the flow rate of the fluid. Additionally, the first fluid delivery system 14 comprises a rotation-style adjustment knob 36 configured to allow an operator to change the pattern of fluid discharge from the nozzle (22, FIG. 4, 5). For instance, an operator may be able to select between a jet and a cone-shaped discharge.

The second fluid delivery system 16 is mounted through the top of the housing 12. A vertical channel 38 extends from the inside of the housing 12 through a hole in the top of the housing 12. The vertical channel 38 may be permanently or detachably fixed to the housing 12. A threaded elbow-type connector 40 is placed at the top of the vertical channel 38 to direct flow from the fluid source into the inner-housing channel-style nozzle (20, FIG. 2-5). The elbow connector 40 reduces the vertical dimension of the apparatus and aligns the first and second delivery systems 14, 16 in the back of the housing 12 for ease of operation. A flexible tube 42 is attached to the elbow connector 40 with an adjustable hose clamp 32*b*. A valve 44 is connected to the opposite end of the flexible tube with another adjustable hose clamp 32*c*. The valve 44 is configured to allow the operator to adjust the flow of the second fluid.

The first and second fluid delivery systems 14, 16 are mounted to the housing 12 in a manner that allows the operator to hold the apparatus by the spray nozzle handle 18 of the first fluid delivery system 14. Valves 34, 36, 44 are positioned to allow the operator to adjust the parameters of fluid discharge, including flow and discharge pattern, without interrupting the cleaning process. The operator may completely stop the flow of one fluid if it is advantageous to do so. For instance, the operator may choose to first use compressed gas to remove loose debris and subsequently use the combination of liquid and gas to remove the remaining contaminants.

Figure 7:
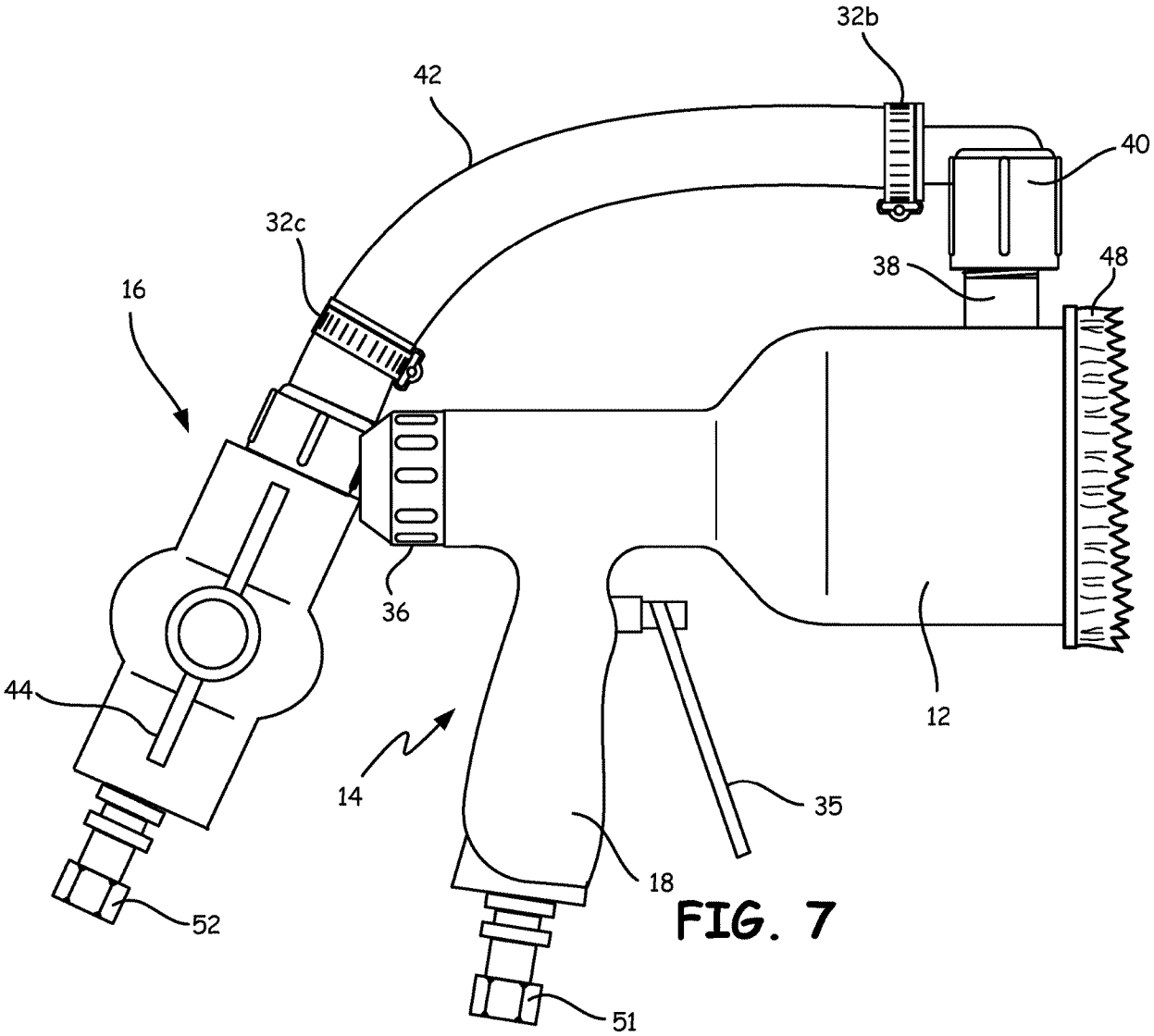
FIG. 7 is a side view of an alternate embodiment of the coil cleaning apparatus.

FIG. 7 shows a side view of an alternate embodiment of the coil cleaning apparatus 10. In this embodiment, the first fluid delivery system 14 comprises a nozzle 22 that is integrally mounted through the back of the housing 12 and a handle 18 which remains outside of the housing 12. The first fluid delivery system 14 has a squeeze lever 35 located on the handle 18 for adjusting the flow rate of the fluid. Additionally, it includes a rotation-style adjustment knob 36 configured to allow an operator to change the pattern of fluid discharge from the first fluid delivery nozzle (22, FIG. 4, 5).

The second fluid delivery system 16 is mounted through the top of the housing 12. A vertical channel 38 extends from the inside of the housing 12 through a hole in the top of the housing 12. The vertical channel 38 may be permanently or detachably fixed to the housing 12. A threaded elbow-type connector 40 is placed at the top of the vertical channel 38 to direct flow from the fluid source into the inner-housing channel-style nozzle (20, FIG. 1-5). The elbow connector 40 reduces the vertical dimension of the apparatus and aligns the first and second delivery systems 14, 16 in the back of the housing 12 for ease of operation. A flexible tube 42 is attached to the elbow connector 40 with an adjustable hose clamp 32*b*. A valve 44 is connected to the opposite end of the flexible tube with another adjustable hose clamp 32*c*. The valve 44 is configured to allow the operator to adjust the flow of the second fluid.

Valves 35, 36, 44 are positioned to allow the operator to adjust the parameters of fluid discharge, including flow and discharge pattern, without interrupting the cleaning process. The operator may completely stop the flow of one fluid if it is advantageous to do so. For instance, the operator may choose to first use compressed gas to remove loose debris and subsequently use the combination of liquid and gas to remove the remaining contaminants. Both the first and second fluid delivery systems 14, 16 may be equipped with quick couplers 51, 52 for easy connection to a fluid source.

The housing 12 comprises a seal 48 around the front edge that contacts the coil 50 during operation. The seal 48 helps prevent loss of liquid from the front of the housing 12 and prevents the housing 12 itself from damaging the coil 50 if pressed too firmly against it. The seal 48 may be a brush, foam, or similar structure.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cleaning apparatus configured to clean a coil of a heat exchanger, comprising:

a body configured to separately carry first and second fluids from first and second fluid sources, respectively;

a first nozzle disposed in the body and configured to deliver the first fluid in a first fluid discharge stream; and a second nozzle disposed in the body and configured to deliver the second fluid, wherein the second nozzle comprises a discharge channel having a plurality of apertures disposed along a length of the channel and positioned to discharge the second fluid in a second discharge stream that intersects the first discharge stream.

2. The cleaning apparatus of claim 1, wherein the discharge channel extends horizontally from a first side of the body to a second side of the body.

3. The cleaning apparatus of claim 2, wherein the body further comprises:

a top; and a bottom;

wherein the first nozzle is positioned adjacent the top of the body and the discharge channel is positioned adjacent the bottom of the body.

4. The cleaning apparatus of claim 2, further comprising:

a first fluid source coupled to the first nozzle;

a second fluid source coupled to the second nozzle; and at least one valve to adjust at least one of a first or second fluid flow rate or pattern of discharge.

5. The cleaning apparatus of claim 4, wherein the first fluid comprises a cleaning agent selected from the group consisting of water, solvents, detergents, and combinations thereof.

6. The cleaning apparatus of claim 5, wherein the second fluid comprises a compressed gas.

7. The cleaning apparatus of claim 6, wherein the first fluid is discharged from the first nozzle at a rate of 3.8 to 18.9 liters per minute (1 to 5 gallons per minute).

8. The cleaning apparatus of claim 7, wherein the compressed gas is discharged at a pressure of 620 to 689 kilopascals (90 to 100 pounds per square inch) and 0.014 to 0.028 cubic meters per second (30 to 60 cubic feet per minute).

9. The cleaning apparatus of claim 6, wherein the body further comprises:

a third nozzle configured to deliver a third fluid; and a third fluid source coupled to the third nozzle;

wherein the third nozzle comprises an aperture to deliver the third fluid.

10. A method for cleaning a heat exchanger coil, the method comprising:

coupling a first fluid source to a first nozzle;

coupling a second fluid source to a second nozzle, wherein the second nozzle comprises a discharge channel having a plurality of apertures extending along a length of the discharge channel, and wherein the first nozzle and the discharge channel are configured in a single body;

delivering a first fluid in a first discharge stream through the first nozzle toward a surface to be cleaned; and delivering a second fluid in a second discharge stream through the discharge channel;

wherein the second discharge stream intersects the first discharge stream.

11. The method of claim 10, wherein delivering a first fluid comprises:

delivering a cleaning agent selected from the group consisting of water, solvents, detergents, and combinations thereof.

12. The method of claim 11, wherein delivering the second fluid comprises:

delivering a compressed gas.

13. The method of claim 12, and further comprising:

adjusting one of a first fluid flow rate and a second fluid flow rate.

* * * * *